US009650597B2

(12) United States Patent
Kónya et al.

(10) Patent No.: US 9,650,597 B2
(45) Date of Patent: May 16, 2017

(54) GEL COMPOSITION FOR CLEANING PIPELINES AND PIPE-NETWORKS AND THE USE THEREOF

(71) Applicants: OKFT KFT., Algyö (HU); SZEGEDI TUDOMÁNYEGYETEM, Szeged (HU)

(72) Inventors: Zoltán Kónya, Tiszasziget (HU); András Sápi, Jászberény (HU); Tamás Ormay, Szeged (HU)

(73) Assignees: OKFT KFT., Algyö (HU); SZEGEDI TUDOMÁNYEGYETEM, Szeged (HU)

( * ) Notice: Subject to any disclaimer, the term of this patent is extended or adjusted under 35 U.S.C. 154(b) by 0 days.

(21) Appl. No.: 14/899,650

(22) PCT Filed: Jun. 19, 2014

(86) PCT No.: PCT/HU2014/000053
§ 371 (c)(1),
(2) Date: Dec. 18, 2015

(87) PCT Pub. No.: WO2014/203014
PCT Pub. Date: Dec. 24, 2014

(65) Prior Publication Data

US 2016/0130535 A1 May 12, 2016

(30) Foreign Application Priority Data

Jun. 19, 2013 (HU) ..... 1300391
Jun. 16, 2014 (HU) ..... 1400300

(51) Int. Cl.
*C11D 7/06* (2006.01)
*C11D 7/08* (2006.01)
*B08B 9/027* (2006.01)
*C11D 17/00* (2006.01)
*C11D 7/26* (2006.01)
*C11D 11/00* (2006.01)

(52) U.S. Cl.
CPC ..... *C11D 17/003* (2013.01); *C11D 7/06* (2013.01); *C11D 7/08* (2013.01); *C11D 7/261* (2013.01); *C11D 7/268* (2013.01); *C11D 11/0023* (2013.01); *C11D 11/0094* (2013.01); *B08B 9/027* (2013.01)

(58) Field of Classification Search
CPC .. C11D 3/222; C11D 7/06; C11D 7/08; C11D 7/261; B08B 9/027
See application file for complete search history.

(56) References Cited

U.S. PATENT DOCUMENTS

| | | | | |
|---|---|---|---|---|
| 4,543,131 | A | 9/1985 | Purinton, Jr. | |
| 5,215,781 | A | 6/1993 | Lowther | |
| 5,346,339 | A | 9/1994 | Himes et al. | |
| 2009/0293206 | A1* | 12/2009 | Guyot | C11D 1/86 8/159 |

FOREIGN PATENT DOCUMENTS

| | | |
|---|---|---|
| EP | 0 187 396 A1 | 7/1986 |
| RU | 2 114 136 C1 | 6/1998 |

* cited by examiner

*Primary Examiner* — Brian P Mruk
(74) *Attorney, Agent, or Firm* — Jason D. Voight

(57) ABSTRACT

The invention relates to a gel composition comprising 0.6 to 2.5 weight percent of guar gum, 0.01 to 0.05 weight percent of boric acid, 0.003 to 0.007 weight percent of a base, 2.5 to 4.5 weight percent of a short carbon chain alcohol, optionally 0.01 to 0.5 weight percent of additives and the necessary amount of water to reach 100% weight. The invention covers a method for producing the gel composition and the use thereof.

13 Claims, No Drawings

GEL COMPOSITION FOR CLEANING PIPELINES AND PIPE-NETWORKS AND THE USE THEREOF

This is the national stage of International Application PCT/HU2014/000053, filed Jun. 19, 2014.

The invention relates to the production and use of gel composition, capable of cleaning pipelines and pipe-networks.

A number of different gel compositions are known from the state of the art, which are used for cleaning industrial—mainly oil-field or chemical industry—pipelines and pipe-networks ("pigging"). By using gels with the necessary properties, not only the physically removable wastes and/or already detached residues deposited on the bottom of the pipe, and also gases and fluids can be removed with great efficiency, but by including distinct additive materials, like disinfectants, inhibitors and similar chemicals, additional cleaning and other tasks can be done in one step.

Adjusting the properties of the gel results in products capable of providing various tasks. Accordingly, we can distinguish pushing gels, pick-up gels, dehydrating gels and corrosion inhibiting gels also. These different types of gels can be applied individually or they can be combined, forming a so called "gel-train".

Usually polymers are used to create gels. These polymers can be of natural origin, like cellulose derivatives or natural rubbers, or they can be synthetic polymers, like anionic or cationic (co)polymers. The gel-forming material is usually introduced in water or in a mixture of water and organic solvent.

The document EP 0 630 694 describes a gel based on cellulose-ether produced by adding to a cellulose ether made from hydroxyethyl or -propyl cellulose, vinyl-phosphonic acid and an aqueous solution containing a divalent cation at 20-60° C. a cross-linking agent containing Lewis-base or Brönsted-base.

The document U.S. Pat. No. 5,215,781 describes a gelatine based gel, where the gelatine is introduced in a warm fluid and then it is cooled down to room temperature. The properties of the gel are set by using additives.

The document RU 2 114 136 describes a gelling agent made from a water soluble, ethylenediamine based alkylene oxide block copolymer and diallyldimethylammonium chloride cross-linking agent by polymerisation at a ratio of 1:1.5, which will result in a stable and strong structured gel with good sealing capabilities (in case of varying pipeline diameters).

The document U.S. Pat. No. 4,543,131 describes a water based gel made from cross-linked galactomannan based rubber. The properties of the gel are set by using additives and the resulting different types of gels are used together, forming a gel-train.

All of the gels known so far are harmful to the environment and to human health, or they are made of materials which may have effects that are not profoundly examined. Obviously, these gels are not suitable to clean pipe-networks delivering potable water. The later technological application has further requirements, like simple preparation methods, which makes gels with long forming period unfit, or the existence of a properly coherent gel-structure, which prevents breaking-up due to shearing forces rising during the application, and finally the crucial monetary aspects of the prices of the raw materials. For producing a few cubic centimeters of gel to be used in a chromatograph the cost of the starting materials is not a main concern, but in this case we are talking about producing the gel in cubic meter volumes. Considering all the above requirements, perhaps it is understandable, why the literature of the "pigging" gels is so limited.

Guar gum is a well known additive. It is used mainly in the food industry under the name E-412. Guar gum is the grist of the endosperm of the guar beans. Guar beans are cultivated mainly in India and Pakistan, and some smaller plantations can be found in the USA, in Australia and in Africa. The guar beans are grinded and the resulting pale, off-white, free-falling rough or refined grist is called the guar gum.

However, guar gum is hardly forming gels. If guar gum is mixed with water to hydrate it, the problem of clumping will arise, even if small volumes are used. Adding small doses of the refined dispersion of guar gum dust gradually results in forming clumps as it submerges into the water, while the hydrating and wetting effect will occur quickly on the surface of the clumps, preventing hydration of the still dry dust in the core. The number of clumps produced is not reduced by slow stirring, quite contrary it is increasing their numbers. In case at proceeding conversely, namely at not introducing the dust into the water, but inversely adding the water to the dust, gradually or suddenly, similar problem will arise. The clumps will break up by using intensive stirring and a homogeneous suspension will form. It is however questionable what kind of problem will be caused by this phenomenon in industrial scale. In terms of application, clumping is undesirable for two reasons. On one hand the inhomogeneous hydration will make the suspension more dilute, because some amount of the material is located enclosed inside the clumps, making the setup of the correct concentration lumbering, thus rendering the precise technological implementation impossible. On the other hand clumps can cause congestion at narrow places inside the used equipment or inside the treated pipelines.

It is noted, that the water will slowly, but surely reach the dry guar gum dust inside the clumps by diffusion, therefore the clumps will dissolve within one or two days, depending on their sizes, but during this period the suspension will start to biologically degrade (which is unfavourable) due to contamination by microbes, if we do not use a sterile environment or sterilization chemicals.

There is a need therefore to develop such a gel composition, which consists of materials unharmful to the environment and to humans, which can be produced by a quick and simple method, and the properties thereof can be adjusted by changing the composition.

We have found that during the gelling the guar gum a homogeneous gel can be produced by adding boric acid in aqueous solution to the alcoholic suspension of the guar gum homogenized by mixing, then adding a base in aqueous solution to the white suspension thus obtained. By adding the base solution, the white guar gum suspension will gradually develop into a gel.

The object of the invention is a gel composition comprising 0.6 to 2.5 weight percent of guar gum, 0.01 to 0.05 weight percent of boric acid, 0.003 to 0.007 weight percent of a base, 2.5 to 4.5 weight percent of a short carbon chain alcohol, optionally 0.01 to 0.5 weight percent of additives and that amount of water, which is needed to reach 100% quantity.

Furthermore, the object of the invention is a method to produce the gel composition according to the invention, which comprises (a) adding guar gum to a short carbon chain alcohol, (b) mixing it with aqueous solution of boric acid, (c) adding the aqueous solution of a base, (d) optionally, adding one or more additives, and (e) diluting with water to reach the required concentration.

Furthermore, the object of the invention is the use of the gel composition according to the invention to clean pipelines and pipe-networks, preferably to clean potable water pipelines and pipe-networks.

In the gel composition according to the invention, guar gum is the gel forming material, its cross-linked system gives the structure of the gel itself. The amount of the guar gum is usually between 0.6 to 2.5 weight percent, preferably 0.9 to 2.1 weight percent, more preferably 1.0 to 2.05 weight percent.

In the gel composition according to the invention the boric acid ($H_3BO_3$) reacts with the base and takes part in forming the cross-linked structure of the guar gum, because it connects its —OH groups to the long chain guar gum molecules. The amount of the boric acid is usually between 0.01 to 0.05 weight percent, preferably 0.02 to 0.04 weight percent, more preferably 0.03 to 0.035 weight percent.

In the gel composition according to the invention the cross-linking of the guar gum can only happen at the right (alkaline) pH value, thus the use of a base is needed. Furthermore it reacts with the boric acid and it will free —OH groups from it, to connect the molecules of the guar gum together. The base is usually organic or inorganic. The preferred inorganic bases are alkali metal and alkaline earth metal hydroxides, carbonates and bicarbonates, for example NaOH, KOH, $CaOH_2$, $Na_2CO_3$, $K_2CO_3$, $CaCO_3$, $NaHCO_3$, or $KHCO_3$, preferably NaOH. The amount of the base is usually between 0.003 to 0.007 weight percent, preferably 0.045 to 0.006 weight percent, more preferably 0.0053 to 0.0055 weight percent.

In the gel composition according to the invention the short carbon chain alcohol ensures avoiding the clump formation. The short carbon chain alcohol is preferably one to four carbon atom content alcohol, such as methanol, ethanol, n- or isopropanol or n-, iso- or tert-butanol, particularly ethanol. The amount of the short carbon chain alcohol is usually between 2.5 to 4.5 weight percent, preferably 3.0 to 4.0 weight percent, more preferably 3.65 to 3.8 weight percent.

In the gel composition according to the invention the additive material is usually silver, silver-oxide or hydrogen-peroxide. The amount of the additive is usually between 0.01 to 0.5 weight percent, preferably 0.05 to 0.2 weight percent, more preferably 0.08 to 0.1 weight percent.

In the gel composition according to the invention water is used to set the concentration of the gel. Any tap water can be utilized, such as potable water. In order to optimize the gel forming, preferably 7.2 to 7.5 pH water is used.

The properties of the gel composition according to the invention can be modified by using different amount of the named components.

For example, increasing the amount of the guar gum will increase the density and hardness of the gel. Usually the produced gel will become fragile, if the weight percent exceeds 2.5. This can be considered the upper limit of the guar gum concentration. Usually the amount of guar gum is not sufficient to form a stable, coherent gel structure, if the weight percent is below 0.7. The gel formed is fluid-like, and it sticks to the surface of the pipeline. This can be considered as the lower limit of the guar gum concentration.

By changing the amount of the base the speed of the gel-forming can be controlled. Higher concentration means quicker, lower concentration means slower gel-forming.

By changing the amount of the short carbon chain alcohol the viscosity of the gel can be controlled.

Thus different types of gel can be produced by changing the amount of the given components.

In order to produce a pushing gel the amount of the guar gum used has to be increased. The preferable composition of the pushing gel according to the invention is 1.9 to 2.1 weight percent of guar gum, 0.03 to 0.035 weight percent of boric acid, 0.0053 to 0.0055 weight percent of a base, 3.6 to 3.8 weight percent of a short carbon chain alcohol, and the necessary amount of water to reach the 100% weight.

In order to produce an intermediate gel, the amount of the guar gum and boric acid used has to be changed. The preferable composition of the intermediate gel according to the invention is 1.32 to 1.37 weight percent of guar gum, 0.03 to 0.033 weight percent of boric acid, 0.0053 to 0.0055 weight percent of a base, 3.6 to 3.8 weight percent of a short carbon chain alcohol, optionally 0.01 to 0.5 weight percent of additives (preferably hydrogen-peroxide), and the necessary amount of water to reach the 100% weight.

The aim of the pick-up gel is to enable the gel-train to pick up various sizes of residue and fine suspensions with its dedicated pick-up part. To achieve this, it is needed to form such a gel structure, which has a certain degree of inner currents or movements. This forced movement picks up the wastes and delivers them to the inner section of the gel plug itself. The preferable composition of the pick-up gel according to the invention is 1.05 to 1.1 weight percent of guar gum, 0.03 to 0.035 weight percent of boric acid, 0.0053 to 0.0055 weight percent of a base, 3.65 to 3.85 weight percent of a short carbon chain alcohol, optionally 0.01 to 0.5 weight percent of additives (preferably silver), and the necessary amount of water to reach the 100% weight.

In order to produce the gel composition according to the invention usually the following steps are preformed: (a) mixing guar gum with a short carbon chain alcohol, (b) mixing the above with aqueous solution of boric acid, (c) adding the aqueous solution of a base, (d) optionally, adding one or more additives and, (e) diluting with water to reach the required concentration.

During step (a) guar gum is added to a short carbon chain alcohol. Doing this either the preferably grinded guar gum is added gradually or suddenly to a part or whole amount of the short carbon chain alcohol; or the short carbon chain alcohol is added gradually or suddenly to the preferably grinded guar gum. The mixture obtained is stirred until obtaining a homogeneous solution.

During step (b) boric acid is added to water. Doing this either the boric acid is added gradually or suddenly to a part or whole amount of water; or water is added gradually or suddenly to the boric acid. The mixture obtained is stirred until obtaining a homogeneous solution. The solution obtained is added to the solution obtained in step (a); or the solution obtained in step (a) is added to the solution obtained in step (b). The mixture obtained is homogenized by stirring.

During step (c) a base is added to water and then the mixture obtained is added with stirring to the solution obtained in step (b). By adding the base the pH of the mixture is adjusted to a value between 9 to 13, preferably 10 to 12.

Then the optional additives can be added (step (d)) to the solution and if desired, the solution is diluted with water (step (e)).

The steps of the method according to the invention are usually performed at room temperature and normal atmospheric pressure, but the higher temperatures and pressures can also be used.

The mixture obtained is stirred intensively for 10 to 20 minutes, preferably for 14 to 16 minutes. During the stirring gelling is started and by the end of the stirring, the final gel structure is formed. The gel obtained can be directly put to use without any further treatment.

Furthermore, we found that the formation of the gel structure can be very easily and simply achieved, if the stirring during the individual steps of the process is done at the given speed (rpm) and for the given period of time.

According to one preferred embodiment of the method according to the invention, during step (a) the guar gum is added to the short carbon chain alcohol and the mixture is stirred for 8 minutes at 60 to 61 rpm, then for a further 7 minutes at 85 to 90 rpm. During step (b), the mixture of step (a) is mixed with the aqueous solution of boric acid and the mixture obtained is stirred for 5 minutes at 90 to 100 rpm. During step (c) the aqueous base is added to the mixture obtained in step (b) and the mixture obtained is stirred for 3 minutes at 30 rpm. Then, during step (d) optionally one or more additives are added and during step (e) the mixture obtained in step (c) or step (d) is diluted with water to the desired concentration and the mixture obtained is stirred for 2 minutes at 30 rpm. This way an especially homogeneous and stable gel structure can be produced.

The method according to the invention can be performed using technological equipments common in this field. Preferably reactors with agitating equipment such as agitated reactors and agitated containers are used.

The gel composition according to the invention can be used to clean different pipelines and pipe-networks. The gel composition contains such materials, which are harmless to the environment and harmless to the human health, therefore—contrary to the gels known from the state of the art—it can be used to clean potable water pipelines and pipe-networks, and such technological pipelines, which are utilized during the production of items for human consumption, like food industry or pharmaceutical industry pipelines.

The gel composition according to the invention is capable of removing various fluid-like wastes (oil- or water-based wastes) and solid residues (sand, rust, fat and the like). Using the gels with the suitable properties not only the easily removable and/or already loose residues, fluids and gases can be removed, but by adding gel with different properties to the gel-train, for example gel elements with added disinfectant or inhibiting chemicals the cleaning and other tasks can be performed by a single treatment.

The gel composition according to the invention can be used individually or it can be combined with other gel compositions, as a single gel or one or more unique part(s) of a gel train.

During the application of the gel composition according to the invention the regular practice used for cleaning pipelines and pipe-networks with gel compositions known for a person skilled in the field can be used.

The invention will be described in a more detailed manner by the examples below without limiting the scope of the invention to these examples only.

General procedure to produce the gel composition according to the invention:

Necessary amount of boric acid is added to 100 liters of water, then is stirred intensively for 10 to 15 minutes, until the boric acid dissolves (until the particles disappear). Meanwhile necessary amount of guar gum is added to 5 liters of ethanol. It is stirred intensive, in order to let the ethanol humect the guar gum. Then necessary amount of solid NaOH base is solved in 4 liters of water.

Thereafter, the ethanol mixed with the guar gum is being slowly added to the water mixed with boric acid, under continuous stirring the mixture. After adding the whole amount it is further stirred for 10 to 15 minutes, then it is started to add the NaOH solution, under continuous stirring the mixture.

After mixing all ingredients together an intensive stirring for a period of 10 to 20 minutes is performed, while the gelling starts and finally the gel structure is formed.

The following gel compositions can be produced according to the above general procedure:

Example 1: Composition of a Pushing Gel 2140 grams of guar gum (Vidogum)
66.34 grams of boric acid
5.0 liters of pure absolute ethanol
100 liters of tap water
1.43 liters of 0.4 weight percent NaOH solution Example 2: Composition of an Intermediate Gel 1430 grams of guar gum (Vidogum)
44.3 grams of boric acid
5.0 liters of ethanol
100 liters of tap water
1.43 liters of 0.4 weight percent NaOH solution Example 3: Composition of a Pick-Up Gel 1140 grams of guar gum (Vidogum)
35.34 grams of boric acid
5.0 liters of ethanol
100 liters of tap water
1.43 liters of 0.4 weight percent NaOH solution Example 4: Production of a Pushing Gel 50 liters of water is poured into an agitated reactor. 2140 grams of guar gum is added to 5 liters of absolute ethanol, then it is poured into the agitated reactor and stirred for 8 minutes at 60 rpm, then for 7 minutes at 85 rpm. 66.34 grams of boric acid is added, and the intensity of the stirring is increased to 95 rpm, since the gelling already starts at this point. The gelling mixture is stirred for 5 minutes.

Then 1.43 liters of 0.4 weight percent NaOH solution is added, and the intensity of stirring is decreased to 30 rpm and it is continued to stir for 3 minutes at this stirring rate. Finally the mixture is diluted with 50 liters of water and stirred for 2 minutes at 30 rpm, which results in a homogeneous and stable gel composition.

The benefits of the invention can be summarized as below:

It is a cost effective, timesaving technology.
It can provide effective cleaning, even at relatively low speeds.
It is applicable in pipelines with varied inside diameters.
There is no risk of mechanical pigging equipment becoming stuck.
It can effectively remove fluids and gases.
It can provide cleaning, drying and disinfection during only one intervention.
The gels are harmless to human health and to the environment.
Completing the task does not require lengthy preparations.
It is not needed to disrupt the pipelines to complete the cleaning.
Wide spectrum of possible additives is feasible.
Significantly lower amounts of chemicals are used compared to chemical treatments.

The invention claimed is:

1. A gel composition comprising 0.6 to 2.5 weight percent of guar gum, 0.01 to 0.05 weight percent of boric acid, 0.003 to 0.007 weight percent of a base, 2.5 to 4.5 weight percent of an alcohol containing one to four carbon atoms, optionally 0.01 to 0.5 weight percent of additives and the necessary amount of water to reach 100% weight.

2. The gel composition according to claim 1, wherein the base is NaOH.

3. The gel composition according to claim 1, wherein the alcohol is ethanol.

4. The gel composition according to claim 1 in the form of a pushing gel comprising 1.9 to 2.1 weight percent of guar gum, 0.03 to 0.035 weight percent of boric acid, 0.0053 to 0.0055 weight percent of a base, 3.6 to 3.8 weight percent of an alcohol containing one to four carbon atoms and the necessary amount of water to reach 100% weight.

5. The gel composition according to claim 1 in the form of an intermediate gel comprising 1.32 to 1.37 weight percent of guar gum, 0.03 to 0.033 weight percent of boric acid, 0.0053 to 0.0055 weight percent of a base, 3.6 to 3.8 weight percent of an alcohol containing one to four carbon atoms, optionally 0.01 to 0.5 weight percent of additives and the necessary amount of water to reach 100% weight.

6. The gel composition according to claim 1 in the form of a pick-up gel comprising 1.05 to 1.1 weight percent of guar gum, 0.03 to 0.035 weight percent of boric acid, 0.0053 to 0.0055 weight percent of a base, 3.65 to 3.85 weight percent of an alcohol containing one to four carbon atoms, optionally 0.01 to 0.5 weight percent of additives and the necessary amount of water to reach 100% weight.

7. A method of producing the gel composition according to claim 1, which comprises (a) adding guar gum to an alcohol containing one to four carbon atoms, (b) mixing it with aqueous solution of boric acid, (c) adding the aqueous solution of a base, (d) optionally adding one or more additives, and (e) diluting it with water to reach the required concentration.

8. The method according to claim 7, wherein the mixture obtained in step (a) is stirred for 8 minutes at 60-61 rpm, then for 7 minutes at 85-90 rpm, the mixture obtained in step (b) is stirred for 5 minutes at 90-100 rpm, the mixture obtained in step (c) is stirred for 3 minutes at 30 rpm, and the mixture obtained in step (e) is stirred for 2 minutes at 30 rpm.

9. Gel composition according to claim 1 for use in cleaning pipelines and pipe-networks.

10. A method for cleaning pipelines and pipe-networks, said method comprising applying the gel composition according to claim 1 to the pipelines or pipe-networks.

11. The method according to claim 10, wherein the base is NaOH, the alcohol is ethanol, and the pipelines or pipe-networks are for potable water.

12. The gel composition according to claim 5 wherein the additives include hydrogen-peroxide.

13. The gel composition according to claim 6 wherein the additives include silver.

* * * * *